United States Patent [19]

Grüber

[11] 4,267,712

[45] May 19, 1981

[54] PATTERN-CREATING DEVICE FOR ADVANCING TEXTILE OR SIMILAR WEBS

[75] Inventor: Heinz Grüber, Tönisvorst, Fed. Rep. of Germany

[73] Assignee: Eduard Küsters, Krefeld, Fed. Rep. of Germany

[21] Appl. No.: 122,861

[22] Filed: Feb. 20, 1980

[30] Foreign Application Priority Data

Sep. 24, 1979 [DE] Fed. Rep. of Germany ..... 2938494

[51] Int. Cl.[3] ..... D06B 1/06

[52] U.S. Cl. ..... 68/205 R; 118/325

[58] Field of Search ..... 68/200, 205 R; 118/324, 118/325, DIG. 4

[56] References Cited

U.S. PATENT DOCUMENTS 3,293,063 12/1966 Pohl et al. ..... 118/324 X
3,964,860 6/1976 Leifeld ..... 68/205 R X
4,157,652 6/1979 Mathes et al. ..... 68/205 R X
4,170,958 10/1979 Moser ..... 68/205 R X

*Primary Examiner*—Philip R. Coe
*Attorney, Agent, or Firm*—Kenyon & Kenyon

[57] ABSTRACT

In a pattern-creating device for advancing textile or similar webs wherein the pattern creating liquid is present in the form of a film which extends over the entire width of the web and flows onto the web over a run-off surface with a rotatable tube extending along the run-off surface, the tube provided with a plurality of pattern creating elements which are distributed over its surface and make the film which flows down over the run-off surface, nonuniform at certain points, the pattern creating elements are soft resilient wiper elements, attached to the circumference of the tube so as to occupy only a fraction of the dimension of the tube in the longitudinal and circumferential direction, which are brought into contact with the run-off surface in its interior at a distance from the lower edge of the run-off surface.

10 Claims, 6 Drawing Figures

PATTERN-CREATING DEVICE FOR ADVANCING TEXTILE OR SIMILAR WEBS

BACKGROUND OF THE INVENTION

The invention relates to pattern creating device for advancing textile or similar webs in general and more particularly to a device of this type permitting generating an overall pattern on a web with firmer contours.

A pattern creating device in which a pattern creating liquid is present, prior to being applied to the web, in the form of a film which extends over the entire width of the web and flows onto the web over a run-off surface inclined at an angle, and drops from the lower edge of the run-off surface freely onto the web, the device having a rotatable tube which extends along the run-off surface parallel and spaced therefrom and supported for movement back and forth in its longitudinal direction, the tube provided with pattern making elements which are distributed over its surface and make the film, which flows down over the run-off surface, non uniform at certain points is described in U.S. Pat. No. 4,170,958.

In U.S. Pat. No. 4,170,958 the pattern creating elements consist of air nozzles which are supplied with air from the interior of the tube and direct their air jets on the running surface, whereby the film of pattern creating liquid running off is driven apart in places and is made irregular, and reaches the web in a form appropriate to generate a pattern. The pattern is determined by the character of the pattern creating elements operating with air jets, which bring about a nonuniformity of the liquid on the surface, with correspondingly soft contours.

It is an object of the present invention to provide a pattern creating device of the type described in which patterns of different overall impression are created, which exhibit somewhat firmer contours.

SUMMARY OF THE INVENTION

In accordance with the present invention this object is acheived by utilizing pattern creating elements being in the form of soft resilient wiper elements which are attached to the circumferences of the tube and occupy only a fraction of the dimension of the tube in the longitudinal and circumferential direction thereof with the tube supported adjacent the run-off surface such that the elements engage the run-off surface, in its interior, at a distance from the lower edge of said surface.

The wiping elements engage directly on the run-off surface and, when the tube rotates, wipe with light pressure over the run-off surface with light pressure in order to interrupt the film at their respective locations and displace the liquid laterally or in the fall direction. The wiping elements cause the liquid to be wiped off almost completely in the wiped off zones, and the wiped off zones, in addition, exhibit relatively sharp boundaries. The distance of the points of engagement from the lower edge of the run-off surface result in the edges of the wiped off zones again being diffused slightly when further running down below the point of engagement. The pattern so obtained has a peculiar appearance and is essentially without periodicity. It cannot be copied by any other method.

It is understood that the word "tube" can mean any kind of cylindrical support bodies for the wiping elements.

For example, the present device offers significant advantage over other pattern creating devices using wiping. U.S. Pat. No. 3,964,860 describes how to attack a run-off surface with reciprocating wiper blades and air nozzles. However in that system, a rotary motion of the wiping elements, by means which the wiping process proper is accomplished, is essential.

In U.S. Pat. No. 3,293,063 an applicator is described in which a shaft with revolving elements is provided along the lower edge of a run-off surface, at which, in the circumferential direction, a kind of tabs is attached which, during rotation, slides off from the lower edge of the run-off surface and interrupts the running off of the pattern creating liquid during this interval. When a tab has finished its contact, the respective point of the lower edge of the run-off surface is again free so that pattern creating liquid can run off again. The pattern made with this device produces stripes which have sharp boundaries in the transversal direction and which are not comparable to the pattern of the invention.

The wiper elements of the present invention, can consist of cellular material such as sponge or foam. The latter may have open pores or pores which are closed so as not to take up the pattern creating liquid. Closed pores are preferred. If the material has open pores, they fill up with the pattern creating liquid in operation and then the elements act on further pattern-creating liquid like essentially closed material. When the wiping elements are compressed, the excess amount of liquid is merely given off. This changes the appearance of the pattern somewhat as compared to closed wiping elements. The wiping elements, can also be formed from sections of flexible tubing or from bubbles created by filling an elastic membrane with compressed air: the inside of the bubbles are in communication with the inside of the tube. Furthermore, compresed air is fed to the inside of the tube whereby the elastic material can be inflated to form bubbles of different sizes.

At a small distance from the web, the contours of the individual pattern areas are still defined rather smoothly and clearly, while the contours become dissolved with increasing distance and are finely dispersed outright.

BRIEF DESCRIPTION OF THE INVENTION

DETAILED DESCRIPTION OF THE INVENTION

Figure 1:
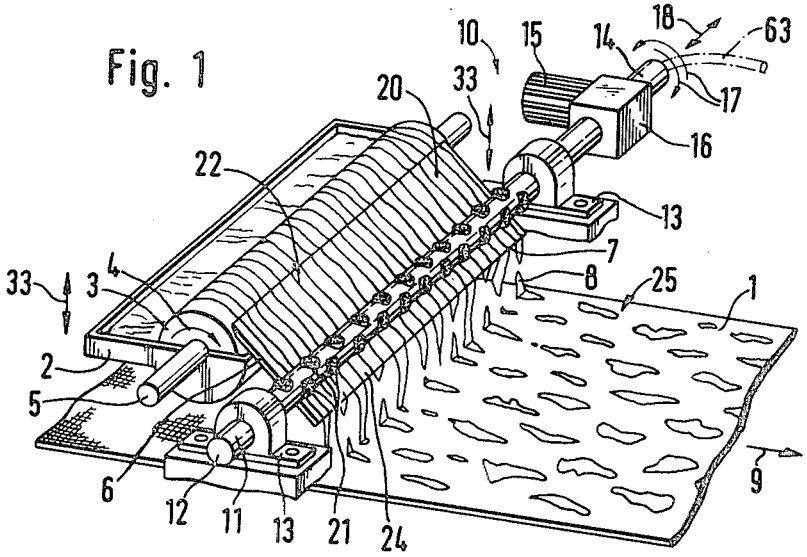
FIG. 1 shows a perspective view of a device for the patterned dyeing of rug webs.

The device 10 of the present invention is used for the patterned dyeing of a rug web 1 advancing horizontally in the direction of the arrow 9. Transversely across the rub web 1, a trough 2 with dyeing liquid is arranged. The lower part of the cylinder 3 is immersed in the dyeing liquid and carries along dyeing liquid at its surface when it rotates in the direction of the arrow 4 about the shaft 5 arranged transversely to the web of material. The dyeing liquid is removed from the cylinder surface by a wiper 6 which points toward the rug web 1 downward at an angle. The surface of the wiper 6 constitutes a run-off surface 20. The liquid flows over the run-off surface 20 in a film 22 which is initially uniform over the width of the web 1, is then made nonuniform in a manner still to be described, and finally is dropped from the lower edge 7 of the run-off surface 20 or the wiper 6, respectively, onto the rug web 1 in an irregular veil 8. The irregularity of the film of dyeing liquid on the run-off surface 20 is accomplished by the tube 11 which is supported on both sides of the wiper 6 in pillow blocks 13. At the rear end 14 of the tube 11, according to FIG. 1, a drive 16 engages the tube. Drive 16 is acted upon by a motor 15 which can impart to the tube 11 a rotary motion in the direction of the arrow 17 as well as a reciprocating motion transversely to the web in the direction of the arrow 18.

Wiping elements 21 are distributed, uniformly or in a pattern, over the surface of the tube 11. The size of the wiping elements 21 corresponds to the size of the desired pattern zones on the web 1, but is, in any event, only a fraction of the dimensions of the tube 11 in its longitudinal and circumferential direction. A single wiping element 21 therefore should not extend over the entire circumference of the tube 11 nor over the entire length. If the tube 11 rotates in the direction of the arrow 25, the wiper elements come into engagement on the run-off surface 20 at a point located at a distance 23 from the lower edge 7 of the run-off surface 20, and there wipe away the film 22 of the pattern creating liquid which flows down the run-off surface 20. The wiper elements 21 consist of elastically resilient material and are slightly deformed in the wiping process so that they bear against the run-off surface 20 with a predeterminable pressure. The distance of the circumference of the tube 11 from the run-off surface 20 is therefore smaller than the height of the individual wiper elements.

After passing the tube 11 with the wiper elements 21, the film 22 flows in an irregular shape downward over the run-off surface 20 and arrives in this form on the web of material 1, there forming the pattern coloring.

The pattern can be influenced by suitable choice of the motions in the direction of the arrows 17 and 18 and, of course, by the design of the wiper elements 21. Of substantial influence on the appearance of the pattern is also the free fall height of the dyeing liquid. For this reason the height of the entire pattern creating device is supported for adjustment above the web 1 in the direction of the arrows 33 (FIG. 1). In this manner different fall heights are obtained from the lower edge of the wiper 6 or the run-off surface 20, respectively, from which point the dyeing liquid free falls until it arrives at the rug web 1 as is indicated in FIG. 2 by the reference numeral 34.

Figure 2:
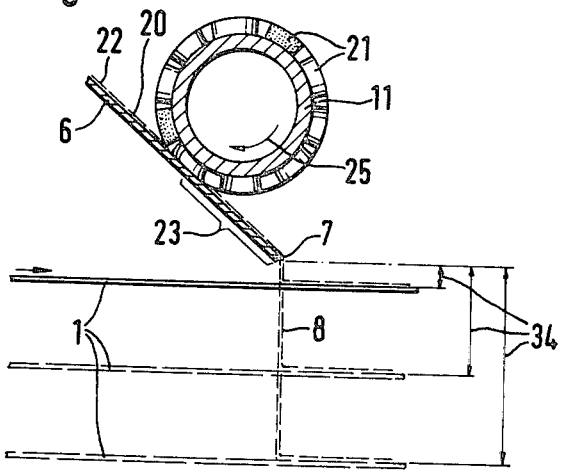
FIG. 2 shows a vertical cross section through the run-off surface and the tube with the wiping elements.
Figure 3:
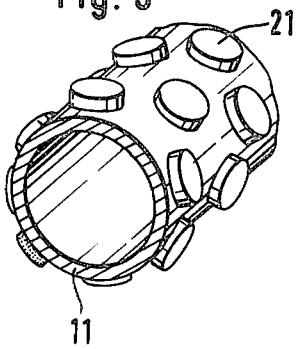
FIGS. 3 to 6 show perspective views of the tube with various designs of the wiping elements.

In the embodiments of FIGS. 1 to 3, the wiper elements 21 consists of flat cylindrical sections from a length of cellular foam material cemented to the tube 11. The cellular foam can be open or closed. While the cross section is shown as a circular cylinder, other desired cross sections can be considered. The height of all wiper elements 21 is essentially the same in the illustrated embodiment, so that the wiper elements can be produced from a length of foam material by cuts perpendicular to the axis.

Figure 4:
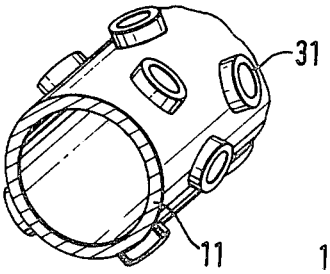

The wiper elements 31 in FIG. 4 comprise sections of elastic tubing, the axis of which is perpendicular to the axis of the tube 11 and which are cemented to the surface thereof or are otherwise fastened.

Figure 5:
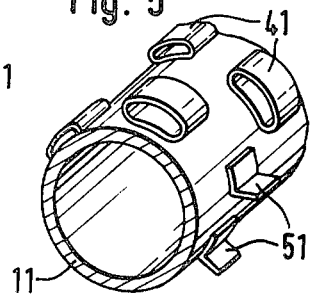

As in evident from FIG. 5, sections of tubing 41 with their axe parallel to the axis of the tube 11 can also be fastened to the tube. Alternatively wiper elements such as the wiper elements 51 in FIG. 5 which consist of angular sections of elastic material, one angle leg of which is cemented to the circumference of the tube with the axe of the element parallel to the axis of the tube may be used.

Figure 6:
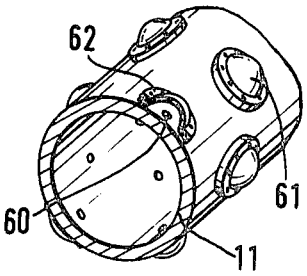

In FIG. 6, the wiper element 61 consist of bubbles of an elastic material. These wiper elements can be closed to secure the edges of the flexible material to the tube and place the wiper elements in communication with the interior of the tube 11 via holes in the wall thereof. This can be accomplished, for instance, by making the wiper element 61 of a large area elastic film oval membrane which has its outer circumference tightly fastened to the tube 11 by a ring 62 arranged along its rim surrounding a hole 60. By supplying pressurized air via the line 63 shown by dashed lines in FIG. 1, the wiper element 61 can be inflated from the inside. In that case, the tube 11 is, of course, closed at its front end 12, according to FIG. 1.

It is understood that combinations of different wiper elements can be employed.

What is claimed is:

1. In a pattern creating device for advancing textile or similar webs, in which a pattern creating liquid is present, prior to being applied to the web, in the form of a film which extends over the entire width of the web and flows onto the web over a run-off surface inclined at an angle, and drops from the lower edge of the run-off surface freely onto the web, said device having a rotatable tube which extends along the run-off surface parallel and spaced therefrom and supported for movement back and forth in its longitudinal direction, said tube containing a plurality of pattern creating elements which are distributed over its surface and are adapted to make the film, which flows down over the run-off surface, nonuniform at certain points, the improvement comprising:

(a) the plurality of pattern creating elements being a plurality of soft resilient wiper elements which are attached to the circumference of the tube and occupy only a fraction of the dimension of the tube in the longitudinal and circumferential direction thereof; and (b) said tube supported adjacent said run-off surface such that said elements engage the run-off surface in the interior thereof at a distance from the lower edge of said surface.

2. The improvement according to claim 1, wherein each of said plurality of wiper elements comprises an element of cellular material.

3. The improvement according to claim 2, wherein each of said plurality of wiper elements comprises an element of closed cellular material.

4. The improvement according to claim 2, wherein said cellular material is sponge or foam material.

5. The improvement according to claim 1, wherein the wiper elements comprise sections of flexible tubing having a central axis.

6. The improvement according to claim 5, wherein the axes of said sections of tubing are perpendicular to the axis of the tube.

7. The improvement according to claim 5, wherein the axis of the section of tubing is parallel to the axis of the tube.

8. The improvement according to claim 1, wherein each of said wiper elements comprise a piece of elastic material having its edges attached to said tube and filled with a compressible material to form a bubble.

9. The improvement according to claim 8, wherein said compressible material comprises compressed air, the inside of said bubble is in communication with the inside of said tube and further including means for feeding compressed air to the inside of said tube whereby said elastic material can be inflated to form bubbles of different sizes.

10. The improvement according to claim 1, wherein said run-off surface is supported such that the height of the lower edge of the run-off surface above the web is variable.

* * * * *